US005819944A

United States Patent [19]

Terrasi

[11] Patent Number: 5,819,944

[45] Date of Patent: Oct. 13, 1998

[54] CONTAINER FOR PRODUCTS SUCH AS PASTILLES AND THE LIKE

[75] Inventor: Giuseppe Terrasi, Benevello, Italy

[73] Assignee: Soremartec S.A., Schoppach-Arlon, Belgium

[21] Appl. No.: 931,243

[22] Filed: Sep. 16, 1997

Related U.S. Application Data

[63] Continuation of Ser. No. 688,099, Jul. 29, 1996, abandoned.

[30] Foreign Application Priority Data

Aug. 9, 1995 [CH] Switzerland ..... 2289/95

[51] Int. Cl.[6] ..... B65D 83/04

[52] U.S. Cl. ..... 206/534; 206/540; 206/804; 222/386.5

[58] Field of Search ..... 206/528, 534, 206/535, 540, 804, 817; 221/64, 65; 222/392, 386.5

[56] References Cited

U.S. PATENT DOCUMENTS

| | | | |
|---|---|---|---|
| 1,673,535 | 6/1928 | Sheehy . | |
| 1,717,320 | 6/1929 | Victor | 206/817 |
| 2,047,090 | 7/1936 | Woolfson | 217/7 |
| 3,108,711 | 10/1963 | Anton | 221/92 |
| 3,231,139 | 1/1966 | Bouet | 222/95 |
| 3,260,405 | 7/1966 | Frischer et al. | 221/32 |
| 3,589,505 | 6/1971 | Burniski | 206/804 |
| 5,056,683 | 10/1991 | O'Brien et al. | 221/64 |
| 5,088,602 | 2/1992 | Heyderman et al. | 206/804 |
| 5,330,056 | 7/1994 | De La Rocha | 206/804 |

FOREIGN PATENT DOCUMENTS

| | | | |
|---|---|---|---|
| 605428 | 11/1934 | Germany . | |
| 1365040 | 8/1974 | United Kingdom . | |
| 1466264 | 3/1977 | United Kingdom . | |
| WO 94/14682 | 7/1994 | WIPO | 221/65 |

*Primary Examiner*—Paul T. Sewell
*Assistant Examiner*—Nhan T. Lam
*Attorney, Agent, or Firm*—Rothwell, Figg, Ernst & Kurz, P.C.

[57] ABSTRACT

The container includes at least one wall element made, for example, in the form of a tape or band, which is movable so as progressively to reduce the containment volume for the product inside the container as the product is removed from the container itself so that uncontrolled movement of product remaining in the container is prevented.

29 Claims, 1 Drawing Sheet

CONTAINER FOR PRODUCTS SUCH AS PASTILLES AND THE LIKE

This is a continuation of application Ser. No. 08/688,099, filed Jul. 29, 1996 now abandoned.

DESCRIPTION

The present invention concerns containers for products such as pastilles and the like.

Such a container is known, for example, from GB-A-1 365 040.

Containers for the aforesaid type, as described, for example, in GB-a-1 365 040 are usually made in the form of small boxes, for example, of prismatic shape, made from moulded plastics material which may be transparent, or laminar material such as cardboard which, in this case, may be provided with windows to enable the products in the container to be seen.

Such products are defined herein as "pastilles and the like", this nomenclature being understood as including all products in the form of pastilles, tablets, pills, lozenges, capsules etc having small dimensions so as to facilitate their oral consumption. It may, for example, include food products and confectionery, for example, breath fresheners, or pharmaceutical products, or products intended for a different use.

In use of these containers, it is found that, as the products within the container are progressively removed for consumption, the remaining products tend to move in an uncontrolled manner (so-called "dancing") inside the container.

This phenomenon can give rise to at least two disadvantages.

In the first place, the movement of the products inside the container tends to produce a noise (which may be defined as a sort of maracas effect) which can be annoying or at least unpleasant.

Secondly, the products may be damaged by their collisions with one another and with the container walls due to their uncontrolled movement, for example, losing fragments of their surface coatings: this may not be very welcome since on removal from the container the products have lost their original appearance, or are actually damaged: one thinks, for example, of pharmaceutical products in which the thickness and continuity of the outer coating determine the release time of the drug into the user's body.

The present invention therefore aims to provide a container for pastilles and the like which overcomes the aforesaid disadvantages.

According to the present invention, this aim is achieved by virtue of a container for pastilles and the like having the characteristics referred to in the claims.

In summary, the invention is based on the solution of reducing the product containment volume as the product is removed from the container, thereby avoiding sufficient space being left for the product remaining in the container to be able to move uncontrollably.

Figure 1:
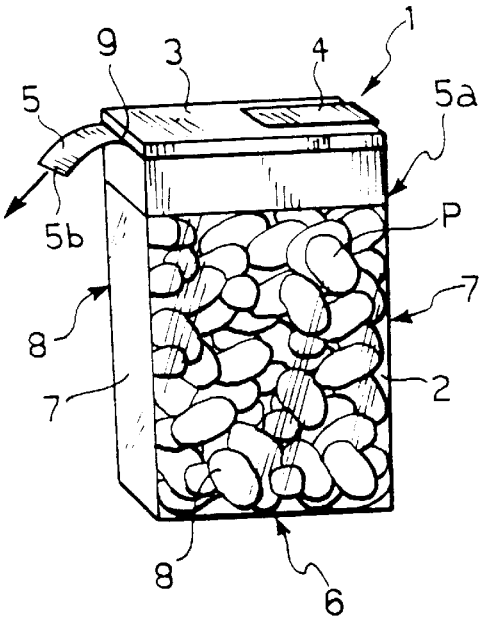
Figure 2:
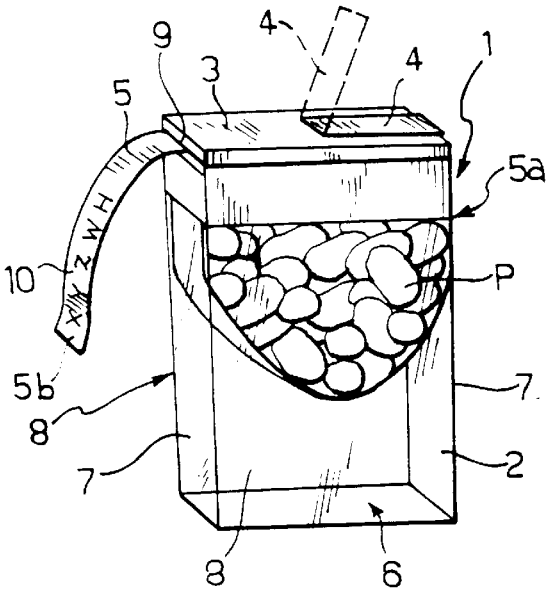
Figure 3:
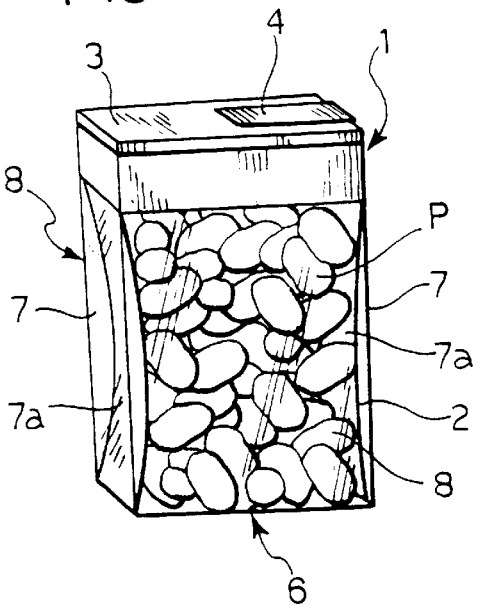
Figure 4:
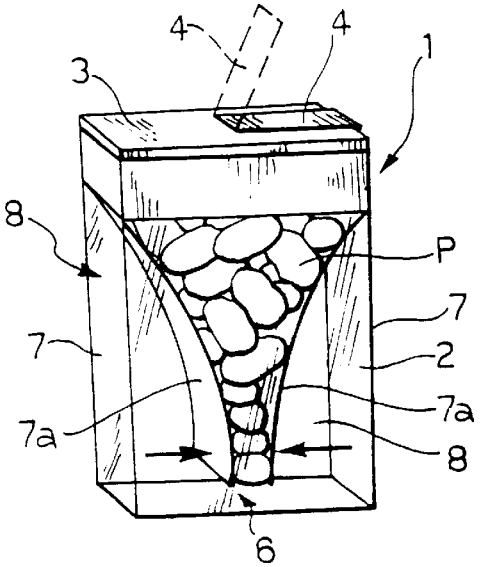

The invention will now be described, purely by way of non-limitative example, with reference to the appended drawings, in which:

FIGS. 1 and 2 show a first possible embodiment of a container according to the invention in two successive functioning conditions; and FIGS. 3 and 4 show a possible alternative embodiment of the invention, also illustrated in two successive functioning conditions.

By way of introduction to the following description it may be seated that, the basic principle of the invention as previously described remaining the same, there are numerous possible ways of putting the invention into practice.

In the first instance, where reference is made in the introduction to the present description and in the following description of two embodiments, to a container in the form of a prism-shaped box, such as that described in GB-A-1 365 040, this shape must not in any way be taken as imperative: the container may, in fact, assume a completely different shape, for example, cylindrical.

Equally, the progressive reduction in the product-containment volume may be achieved by the provision of one or more wall elements which define the product-containment volume and move as the product is consumed. This movement may be achieved either by means of a positive action exerted from the outside, for example (as will be seen in the first of the embodiments described below), by a pull on a tape element, or autonomously, for example, due to the wall element or elements which cause the variation in the dimensions of the containment volume having resilient characteristics (as will be seen in the other embodiment described).

Such resilience may either be an intrinsic property of the wall element or may be achieved by means of an auxiliary element such as, for example, a spring. The or each wall element may equally well be an element added to the basic container (as in the case of the two embodiments which will be described below), or may itself be one of the wall elements of the basic container which is rendered. movable, for example, by making the container in its entirety as a type of syringe with a movable bottom wall loaded by a spring in such a way that it moves progressively towards the container opening as the product is removed.

As already stated, in FIGS. 1 to 4 the reference numeral 1 indicates a container for products such as pastilles and the like (as regards this expression, reference should be made to the terminological premise given in the introduction to the description) which, in the embodiment illustrated, is in the form of a prismatic box defined essentially by an elongate beaker-shaped body 2 of transparent plastics material which allows the product P inside to be seen.

The mouth of the beaker-shaped body 2 is closed by a lid 3 which is also, for example, of plastics material (usually not transparent). The lid 3 can be likened to a type of prismatic stopper which closes the mouth of the body 2 completely and which includes a flap 4 which can be pivoted into an open position as illustrated schematically in broken outline in FIGS. 2 and 4, so as to uncover an opening (not shown in the drawings) through which the product P may be removed from the container 1.

All of the above is realised according to criteria which are well known in the art (see, for example, the previously mentioned document GB-A-1 365 040) and which do not need to be described here as they are not in themselves relevant for the purposes of carrying out the invention. In addition, as has already been said, the choice of a prismatic shape, such as that described here, should not in any way be considered imperative. Naturally, this also applies to the structure of the container, which may be formed from one or more parts, and to the ways in which the product P is removed from the container 1.

In the embodiment illustrated in FIGS. 1 and 2, the reference numeral 5 indicates a type of tape or band positioned inside the body 2 so as to form an additional wall element which delimits the containment volume for the product P.

In the specific embodiment illustrated in FIGS. 1 and 2, the body 2 can be seen to include a pair of minor side walls 7 and a pair of major side walls 8 in addition to a bottom wall or base 6 opposite the lid or stopper 3, the side walls of each pair being opposite one other.

The tape or band 5 is inserted in the body 2 in such a way as to present a first, or head, end 5*a* which is anchored to the container (either to the body 2 or to the lid 3) so as to be attached to the mouth of the body 2 coplanar with one of the minor side walls 7. During packaging and/or filling of the container 1, the tape or band 5 is therefore located inside the container 1 in such a way as, starting at the head or end 5*a*, to extend in contact with the first minor side wall 7 with which the end 5*a* is associated, along the base 6 and along the other minor side wall 7. It finishes by exiting from the opposite side of the container 1 (at the mouth of the body 2) with an end 5*b* which is accessible from outside the container 1. In this way, whether during packaging or filling of the container or in the successive phases of use, the tape or band 5 extends along a generally arcuate path connecting the opposite sides of the mouth of the body 2.

In particular, the exiting of the end 5*b* from the container 1 may be achieved by providing a suitable slot or slit 9 in the zone in which the lid or stopper 3 closes the body 2. The slot 9 may be made equally well in the lid 3 or in the body 2, or even in both elements.

Alternatively, the end 5*b* of the tape or band 5 may simply pass between the edge of the body 2 and the lid 3 which are, in this case, made with a coupling tolerance such as to leave sufficient space for the tape or band 5 to be pulled progressively out of the container 1 without being subject to excessive friction between the body 2 and the lid 3.

FIG. 2 shows how, as the number of products P is reduced by means of their progressive removal, the associated containment volume may progressively be reduced by pulling the end 5*b* of the tape or band 5. This results in the portion of the tape or band 5 extending inside the container 1 and, in practice, inside the body 2, moving progressively closer to the lid 3. The product containment volume is therefore progressively reduced without leaving sufficient space for the product P remaining in the container to move in an uncontrolled way within the container 1.

In the solution seen in FIGS. 1 and 2, the products P, regardless of quantity, are always held in a kind of sack whose base is defined by the portion of the tape or band 5 inside the container 1 and whose sides are defined by the portions of the major side walls 8 of the body 2 between the tape or band 5 and the lid 3 at any time.

In the embodiment shown in FIGS. 1 and 2, the progressive reduction in the containment volume for the product P is therefore left to the user who must progressively extract the tape or band 5 by pulling the end 5*b* as the products are removed from the container 1.

An equivalent effect may be obtained, for example, by making the tape or band 5 from a resilient material and anchoring its ends to the mouth of the body 2. This has the effect that, in its unstressed condition, the resilient tape or band connects the minor side walls 7 by extending across the mouth of the body 2. When the container 1 is filled, the resilient tape or band is stretched to the condition shown in FIG. 1 and is under tension. The resilience of the tape or band 5, which tends to return it to its contracted, initial condition, in this case causes the product P containment volume to be reduced automatically in a way substantially identical to that illustrated in FIG. 2.

The solution to which FIGS. 1 and 2 refer is, however, preferred since this gives the possibility of words, drawings, symbols etc being provided on the tape or band 5, as schematically indicated 10 in FIG. 2. This graphic information may be used for various purposes.

It may, for example, be used for play purposes, to convey, for example, messages relating to the outcome of a game which may be a game of chance (for example, relating to prizes): the container 1 may thus be used for games such as those commonly described as "pull and win".

The information may, however, be of a different nature: for example, in the case of pharmaceutical products, the information 10 may identify extraction lengths of the tape or band 5 which correspond to the progressive emptying of the container 1 based on predetermined doses of the product P, for example, to indicate to the user an excessive intake of product in a predetermined time period.

In the variants referred to in FIGS. 3 and 4, the progressive reduction in the product P containment volume is achieved by the use of two auxiliary wall elements 7*a* attached to the lid 3 (they could also equally be attached to the mouth of the body 2) and having resilient characteristics (similar to those of a blade or leaf spring), whose ends are free to move towards each other in a general scanning or traversing movement across the interior of the body 2. When the container 1 is full of the product P (FIG. 3), the wall elements 7*a* are pushed against the minor side walls 7. As the product P is removed from the container 1, the intrinsic resilience of the wall elements 7*a* causes them to move towards each other, sliding along the major side walls 8 of the body 2. The two elements 7*a* move closer together, thereby progressively reducing the product P containment volume which, in this case, progressively assumes an increasingly marked funnel shape: this choice is clearly dictated by the desire to avoid a situation in which the product P is able to fall into the empty lower part of the body 2 by escaping downwards into the space between the lower ends of the wall elements 7*a*.

As already stated in the introductory part of the description, the use of two (or more) auxiliary wall elements 7*a* is to be understood as a possible example. There may be just one auxiliary wall element which is capable of a general scanning or traversing movement within the body 2 so as to define an increasingly reduced containment volume with the opposite minor side wall 7 and the lid 3.

The movement of the one or two wall elements, instead of being caused by intrinsic resilience, may be caused by a spring such as, for example, a torsion spring situated in correspondence with the mouth of the body 2 or the lid 3 where that end of the wall element or elements 7*a* whose position does not vary relative to the container 1 is located.

Again, at least in principle, the wall element or elements 7*a*, instead of being auxiliary elements, may each be constituted by at least a part of the minor side wall or walls 7 which is able to move progressively.

Again, a solution may be suggested in which, instead of being achieved by a movement along the side walls as in the two embodiments illustrated in the drawings, the progressive reduction in the product P containment volume is achieved by means of a progressive movement of the base 6 towards the lid 3, in a generally syringe-like arrangement.

All of these possible variants, and others which are within the range of an expert in the art, are naturally contained within the ambit of the present invention.

What is claimed is:

1. A container for a plurality of small dispensable products, the container having wall elements defining a containment volume for said products, means for progressively reducing the size of the containment volume within said container as said products are sequentially dispensed to inhibit uncontrolled movement of said products remaining within said container after each sequential dispensation of said products, said means including at least one said wall element being a movable wall element progressively moved to cause a progressive reduction in said containment volume as said products are sequentially removed from said container;

said container including a body having a generally rectangular front wall having a left edge, a right edge, a top edge and a bottom edge and a similarly shaped opposite generally rectangular rear wall having a left edge, a right edge, a top edge and a bottom edge; a first narrow sidewall having a width substantially narrower than a width of said front wall, measured between said left and right side edges, connecting said left edge of said front wall to said left edge of said rear wall; a second narrow sidewall having a width substantially equal to the width of said first narrow sidewall connecting said bottom edge of said front wall to said bottom edge of said rear wall; and a third narrow sidewall having a width substantially equal to the width of said first narrow sidewall connecting said right edge of said front wall to said right edge of said rear wall;

said container also including a lid that closes a top opening of said body having a size generally equal to that of said second narrow side wall;

said lid having a door adjacent to said third sidewall and spaced from said first sidewall such that when said door is opened an opening smaller than the size of said lid is created adjacent said third sidewall;

said at least one said wall element having a width generally equal to the width of said sidewalls and being located within said body so as to lay generally parallel to and against at least one of said sidewalls and to be movable inward towards a center of said body when said products are sequentially removed from said container;

wherein the small dispensable products are smaller than the size of said door opening so as to be dispensed therethrough;

whereby the small dispensable products are dispensable from said container by opening said door and tilting said container such that products are dispensed and thereafter the movable wall element is capable of moving to reduce the containment volume of the remaining product.

2. A container as claimed in claim 1, wherein said movable wall element is a tape.

3. A container as claimed in claim 2, wherein said tape has at least one end accessible from outside said container whereby said tape can be withdrawn progressively from said container to reduce the length of said tape in said container defining said containment volume and thereby cause said progressive reduction in said containment volume.

4. A container as claimed in claim 3, wherein said tape carries graphic information which is exposed to view by the withdrawal of said tape from said container.

5. A container as claimed in claim 4, wherein said graphic information relates to a game of chance.

6. A container as claimed in claim 2, wherein: said container has first and second pairs of opposing side walls; two said wall elements defining said containment volume are constituted by said second pair of opposing side walls; and said movable wall constituted by said tape extends from one to the other of said first pair of opposing side walls between said second pair of opposing side walls such that said containment volume has a generally sack shape.

7. A container as claimed in claim 2, wherein it includes a containment body defining an open mouth and said tape extends in a generally arcuate path so as to connect opposite sides of said mouth.

8. The container according to claim 2, wherein said container has a dispensing opening for dispensing said small dispensable products from said container, and wherein said container has a separate slot through which said tape is progressively drawn from said container.

9. The container according to claim 2, wherein one end of said tape is fixedly connected proximate said third sidewall to at least one of said lid and said container proximate to said lid and extends along said third, second and first sidewalls and extends out of said container through a slot adjacent said first sidewall.

10. The container according to claim 9, wherein at least said front and rear walls of said container are made with a transparent plastics material that allows the small dispensable products therein to be seen, whereby said movable wall element does not obstruct view into said container through said front and rear walls when said container is completely filled with products.

11. The container according to claim 9, wherein at least said front and rear walls of said container are made with a transparent plastics material that allows the small dispensable products therein to be seen, whereby said movable wall element does not obstruct view into said container through said front and rear walls when said container is completely filled with products.

12. A container as claimed in claim 1, wherein it includes resilient means for moving said at least one movable wall element.

13. A container as claimed in claim 1, wherein said at least one movable wall element is intrinsically resilient, said movable wall element is resiliently deformed to an extended condition to maximise said containment volume and the movement of said movable wall element to cause said progressive reduction in said containment volume occurs by virtue of the tendency of said movable wall element to return to an undeformed rest condition.

14. A container as claimed in claim 1, wherein said at least one movable wall element comprises a blade-like member.

15. A container as claimed in claim 14, wherein it includes two said movable wall elements each comprising a blade-like member, said members defining said containment volume between them and being movable towards each other to cause said progressive reduction in said containment volume.

16. A container as claimed in claim 14, wherein said container has respective pairs of opposing side walls in a prismatic arrangement defining an open mouth at one end and wherein said at least one blade like member is attached to one of said side walls adjacent said mouth.

17. The container according to claim 1, wherein container has a lid which covers an opening therein and wherein said lid has a dispensing opening through which said product is removed.

18. The container according to claim 17, wherein said movable wall element is attached to said lid.

19. The container according to claim 1, wherein said movable wall element is made from a resilient material that elastically deforms when said container is filled with the small dispensable products and that progressively moves towards an undeformed state as the product is dispensed, thereby reducing a space in which the product is contained.

20. The container according to claim 19, wherein said movable wall element is a tape.

21. The container according to claim 1, wherein at least said front and rear walls of said container are made with a transparent plastics material that allows the small dispensable products therein to be seen, whereby said movable wall element does not obstruct view into said container through said front and rear walls when said container is completely filled with products.

22. In combination:

a) a container for a plurality of small dispensable products, the container having wall elements defining a containment volume for said products, means for progressively reducing the size of the containment volume within said container as said products are sequentially dispensed to inhibit uncontrolled movement of said products remaining within said container after each sequential dispensation of said products, said means including at least one said wall element being a movable wall element progressively moved to cause a progressive reduction in said containment volume as said products are sequentially removed from said container;

said container including a body having a generally rectangular front wall having a left edge, a right edge, a top edge and a bottom edge and a similarly shaped opposite generally rectangular rear wall having a left edge, a right edge, a top edge and a bottom edge; a first narrow sidewall having a width substantially narrower than a width of said front wall, measured between said left and right side edges, connecting said left edge of said front wall to said left edge of said rear wall; a second narrow sidewall having a width substantially equal to the width of said first narrow sidewall connecting said bottom edge of said front wall to said bottom edge of said rear wall; and a third narrow sidewall having a width substantially equal to the width of said first narrow sidewall connecting said right edge of said front wall to said right edge of said rear wall;

said container also including a lid that closes a top opening of said body having a size generally equal to that of said second narrow side wall;

said lid having a door adjacent to said third sidewall and spaced from said first sidewall such that when said door is opened an opening smaller than the size of said lid is created adjacent said third sidewall;

said at least one said wall element having a width generally equal to the width of said sidewalls and being located within said body so as to lay generally parallel to and against at least one of said sidewalls and to be movable inward towards a center of said body when said products are sequentially removed from said container;

wherein the small dispensable products are smaller than the size of said door opening so as to be dispensed therethrough;

whereby the small dispensable products are dispensable from said container by opening said door and tilting said container such that products are dispensed and thereafter the movable wall element is capable of moving to reduce the containment volume of the remaining product; and b) a plurality of small dispensable products disposed within said container.

23. The combination according to claim 22, wherein said movable wall element is a tape, wherein said container has a dispensing opening for dispensing said small dispensable products from said container, and wherein said container has a separate slot through which said tape is progressively drawn from said container.

24. The combination according to claim 23, wherein one end of said tape is fixedly connected proximate said third sidewall to at least one of said lid and said container proximate to said lid and extends along said third, second and first sidewalls and extends out of said container through said slot through which said tape is drawn.

25. The combination according to claim 22, wherein container has a lid which covers an opening therein and wherein said lid has a dispensing opening through which said product is removed.

26. The combination according to claim 25, wherein said movable wall element is attached to said lid.

27. The combination according to claim 22, wherein at least said front and rear walls of said container are made with a transparent plastics material that allows the small dispensable products therein to be seen, whereby said movable wall element does not obstruct view into said container through said front and rear walls when said container is completely filled with products.

28. The combination according to claim 22, wherein said width of said first narrow sidewall is less than about one half said width of said front wall.

29. The combination according to claim 22, wherein said width of said first narrow sidewall is less than about one third said width of said front wall.

* * * * *